United States Patent [19]

Weslowski

[11] Patent Number: 4,643,825

[45] Date of Patent: Feb. 17, 1987

[54] BULK CONTAINER SYSTEM FOR HIGH PURITY LIQUIDS

[75] Inventor: Robert G. Weslowski, Boothwyn, Pa.

[73] Assignee: General Chemical Corporation, Morristown, N.J.

[21] Appl. No.: 678,749

[22] Filed: Dec. 6, 1984

Related U.S. Application Data

[63] Continuation-in-part of Ser. No. 446,937, Dec. 6, 1982, abandoned.

[51] Int. Cl.[4] ..... B01D 35/04

[52] U.S. Cl. ..... 210/188; 210/196; 210/436; 210/454; 220/254; 220/288; 220/375; 222/546; 222/554

[58] Field of Search ..... 220/254, 288, 375, 371; 217/98, 99, 100, 101, 107, 108, 110, 105; 222/544, 545, 546, 547, 548, 549, 554; 210/196, 197, 232, 238, 436, 454, 258, 472, 188; 55/45, 46, 171

[56] References Cited

U.S. PATENT DOCUMENTS

| | | | |
|---|---|---|---|
| 397,795 | 2/1889 | Gates | 217/110 |
| 871,073 | 11/1907 | Spikes | 217/99 |
| 1,480,103 | 1/1924 | Orosz | 217/100 |
| 1,683,823 | 9/1928 | Heil | 220/288 |
| 1,918,903 | 7/1933 | Fletcher | 222/568 |
| 2,025,852 | 12/1935 | Dillhoefer, Jr. | 220/375 |
| 2,083,866 | 6/1937 | Rice | 222/568 |
| 2,124,685 | 7/1938 | Brendel | 217/105 |
| 2,191,447 | 2/1940 | Beardsley | 55/417 |
| 2,286,175 | 6/1942 | Wackman | 220/375 |
| 2,597,593 | 5/1952 | Neuner | 222/539 |
| 2,678,480 | 5/1954 | Lapin | 222/547 |
| 3,050,218 | 8/1962 | Harvey | 222/568 |
| 3,130,855 | 4/1964 | Gunn, Jr. | 222/547 |
| 3,159,306 | 12/1964 | Lyall | 220/63 |
| 3,167,221 | 1/1965 | Feinstein et al. | 222/539 |
| 3,502,211 | 3/1970 | Pölnitz et al. | 210/258 |
| 3,908,871 | 9/1975 | Gottwald | 137/212 |
| 4,347,946 | 9/1982 | Nichols | 220/375 |
| 4,505,824 | 3/1985 | Akamine et al. | 210/196 |
| 4,548,344 | 10/1985 | Hestehave et al. | 222/539 |

FOREIGN PATENT DOCUMENTS 444909 3/1942 France .

*Primary Examiner*—Peter Hruskoci
*Assistant Examiner*—Wanda L. Millard
*Attorney, Agent, or Firm*—Arthur J. Plantamura

[57] ABSTRACT

A system is provided for filling, for purifying liquids in a shipping container and for maintaining the high purity during withdrawal from the bulk shipping container of liquids, such as high purity liquids. In the system a specially designed bung adapted to fit shipping containers, such as pails and drums which may be made of a suitable plastic, metal, e.g. stainless steel, or other material of construction. The special bung has at least two openings, including an opening into which is fitted a dip tube that reaches contiguous to the bottom of the container. The special bung also has an opening into which a gas filter can be secured. In the system, the contents of the container can be pumped through the dip tube while maintaining the integrity of the product against contamination. The purity of the liquid can be upgraded by pumping, i.e., recirculating the liquid through a filtration media and returned to the container. A gas filter to purify air or vapor passing into or out of the container avoid pressure or vacuum buildup. Both openings in the bung are fitted with plugs to seal the container during the shipment of the filled containers. Containers fitted with the special bung are designed for repeated use, i.e., returnable containers, and each container is preferably dedicated to the packaging of only a single high purity liquid chemical product.

5 Claims, 11 Drawing Figures

1/4

BULK CONTAINER SYSTEM FOR HIGH PURITY LIQUIDS

BACKGROUND OF THE INVENTION

This is a continuation-in-part of U.S. patent application Ser. No. 446,937 filed on Dec. 6, 1982, now abandoned.

Various liquids which are shipped in bulk containers are exposed to conditions which adversely affect the level of purity of these liquids. In many situations the maintenance of high purity is necessary for the practical acceptance of the liquid. As an example, in semiconductor applications it is essential that chemicals of high purity be used in various processing steps; otherwise the resulting product is not acceptable. The sources of contamination for these bulk liquids may be introduced at various stages such as when the bulk container is filled or when the liquid in the bulk container is withdrawn and, particularly, when only a part of the liquid is withdrawn and the bulk container is recapped to preserve the balance of the contents for a subsequent use. In such cases the contaminant may be introduced by the bung which is contaminated or even by the air which displaced the amount of liquid withdrawn from the container. In some instances a quantity of liquid already in the bulk container is less than the desired purity due to the original relatively low purity level or because the product has been subsequently exposed to contaminants, and it is important that this purity be upgraded without requiring that the product be returned to the packaging source for reprocessing or otherwise upgrading of the purity.

It is apparent, accordingly, that a need exists for a bulk packaging purification and delivery system that provides for maintaining a high level of purity of the product in a bulk liquid container and for facilitating the upgrading of the purity of the liquid in the container.

SUMMARY OF THE INVENTION

The advantageous results of the invention are attained by the provision of a circulating system for the chemical which uses a specially designed closure or bung adapted to receive, in combination with one or more openings in the bung and a dip tube which reaches from the bung into the container. The bung arrangement is adapted to be applied to a variety of commercially available shipping containers.

Bulk containers range in size from five gallon pails through fifty-five gallon and larger drums and/or tanks. These containers may be of standard design and materials of construction available from various vendors or they may be custom designed using special materials of construction.

The procedure for packaging the high purity liquid products in these bulk containers normally would involve cleaning the bulk containers to be used, both the inside and the outside of the container, preferably with a detergent followed if appropriate by a rinse which may be a fluorocarbon drying solvent, to remove all gross contamination. The traces of drying solvent are expelled by blowing a filtered dry air stream into the container. Other cleaning methods may, of course, be employed.

The cleaned container would then be fitted with the bung described in therein having outside dimensions adapted to fit the container. The bung may be made of suitable material, e.g., a plastic, such as fluorocarbon resin, polyalkylene resin, nylon, and the like; stainless steel, or other materials of construction compatible with the product to be packaged. The thread type of the bung which secures it to the container conforms to that of the original container. The bung may comprise any appropriate configuration which is suitable to match the container opening. The thread type may be national pipe thread (NPT), buttress thread, machine thread, or any other thread type required to match the thread used in the container bung opening.

The bung has one larger (e.g., $\frac{3}{4}''$) NPT threaded opening and one relatively smaller (e.g., $\frac{1}{4}''$) NPT threaded opening. The larger opening is fitted with a dip tube that reaches into the container to a depth contiguous to the bottom. The dip tube preferably is made of the same material of construction as the special bung. Such material of construction may depend on the container contents and on the regulatory requirements and may be either steel, plastic, etc. The filtered product is pumped out of the cleaned container through this dip tube.

The openings and the dip tube secured in one of the openings in the bung are used in various applications. For example, after a container has been cleaned and fitted with the special bung and dip tube, the container is filled with a liquid product of suitable purity. To accomplish this, unfiltered product is pumped from storage tanks or drums through an appropriate filtration system, such as a 0.2 micron absolute filter, into the clean container. As the container fills with product, the air in the container, together with any product fumes, will escape through the smaller opening and vent (gas) filter which is screwed into the opening. The filter may be connected to an exhaust system.

In another application, after a clean container is filled with product, it may be necessary that the liquid contents be recirculated through a liquid filter to remove any particulate contamination which may have been in the container or which may have been introduced into the liquid product or the container in the filling process. In recirculating the product, a pump picks up the material through the dip tube in the bung opening and pumps the product through the filter(s) and back into the container.

Advantageously the system provides the capability of readily upgrading and/or maintaining the high purity of a chemical in a shipping container or drum by utilizing the bung with a plurality of holes, i.e., at least one hole in which is secured a dip tube and at least one other hole in which a gas filter element may be connected. The arrangement of shipping container and bung with dip tube, and a gas or vent filter, as above described, in combination with a liquid pump, a liquid product filter and interconnecting liquid conduits, i.e., plumbing, provides a system which markedly facilitates the maintenance and immediate availability for use in a high purity state of the liquid product. While the invention is primarily aimed at liquid chemicals employed in processing electronic, e.g., semiconductor components in which high purity of chemicals to avoid contamination is essential, it will be apparent that the system may be applied also to other liquid products, e.g., deionized water, where a high state of purity in the liquid is important.

In general in a preferred embodiment the purification system of the invention involves recirculating of the liquid in the container to reduce impurities that may be present therein. In so doing the liquid product is withdrawn through the dip tube by a pump and fed through a product filter and then returned to the container through a second bung (opening) in the container. A gas filter positioned in the second opening in the bung, contiguous to the dip tube, avoids build-up of pressure or vacuum in the system.

The system also advantageously avoids the contamination of the pure product during unloading of the product from the bulk container. When the product is pumped out of the container through the dip tube, the vent filter attached to the smaller opening permits only clean air or other inert gas to enter the container as product is removed; this also prevents vacuum build-up in the container.

An additional use of the invention relates to unloading the material from the container by using filtered nitrogen or air pressure. The pressuring gas line is connected through a micron filter to the smaller opening. As the gas pressure (of a relatively low order) builds up in the container, the product will flow out of the dip tube which is screwed into the opening in the bung.

Containers that have been filled, recirculated, and checked for quality are ready for shipment. Any fittings, lines, or filters screwed into the bung are removed and replaced with plugs. These plugs may be made of the same material of construction as the bung and are provided with a suitable slot in the top to fit a bung or span wrench or wrench flats projecting above the top.

DESCRIPTION

Figure 1:
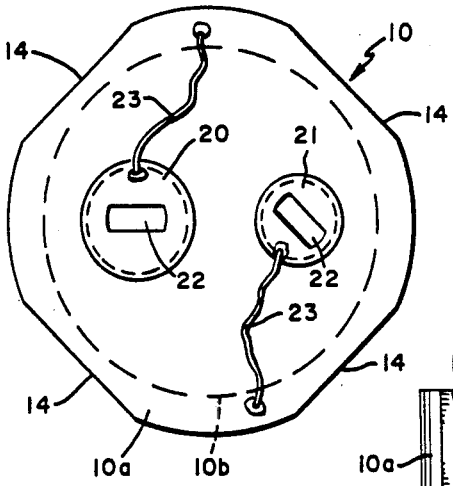
FIG. 1 is a plan view of one form of a bung element showing a pair of openings employed in the system of the invention.
Figure 2:
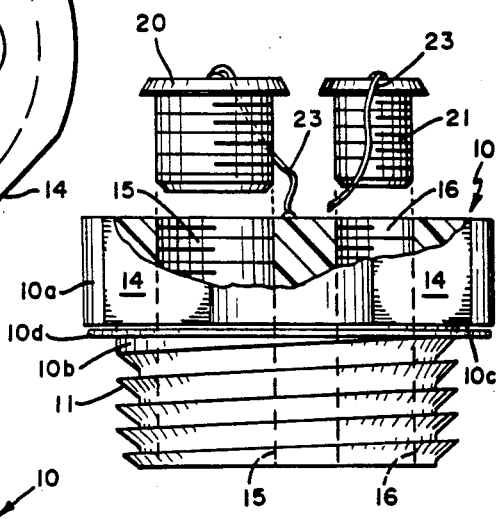
FIG. 2 is a side elevational view partial in section of the bung of FIG. 1 with plugs displaced from the openings.
Figure 3:
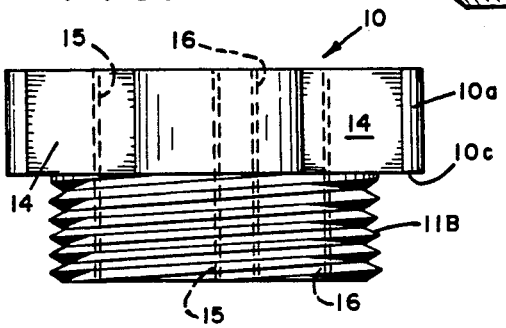
FIG. 3 is a side elevational view of a bung with a variant form of thread for securing the bung to the bulk container.

FIGS. 1 through 3 illustrate one form of a bung suitable for use with the invention designed to fit standard metal or plastic commercial bulk containers, for example, standard 5 gallon or 55 gallon metal, e.g., stainless steel, or plastic containers. The bung is provided in a size and thread design to match that of the bung opening in the container to be serviced.

The bung illustrated comprises a top or closure portion 10*a* of a relatively larger diameter and a thread portion 10*b* of relatively reduced diameter. This difference in diameter affords an ample seat 10*c* to effect a proper seal of the top of the bung on the container contiguous to the container opening. The seat 10*c* may optionally accommodate a gasket 10*d* of suitable composition that is compatible with the container and contents. The bung 10 is provided with a pair of openings, a relatively larger threaded opening 15 which accommodates a dip tube 17 secured to the opening 15 and extending downward in the container to a point continuous to the bottom of the container and through which the liquid passes to vacate the container C and a relatively smaller threaded opening 16 through which air or gases or vapors pass. Both openings 15 and 16 extend through the entire plug 10, i.e., through the upper portion 10*a* and the threaded portion 10*b*. Threaded plugs 20 and 21 are provided for the openings 15 and 16, respectively. The dip tube 17 is shipped with the container C and is secured to the bottom opening 15 in the bung. The plugs 15 and 16, optionally, may be tethered, as shown, by a suitable means such as by a link chain 23 to the bung 10. The bung 10 may be made of a suitable plastic, which may be homopolymers or copolymers, ethylene chlorotrifluoroethylene, e.g., polypropylene, polyethylene, co-polymer, polytetrafluoroethylene and other fluoroplastics, nylon and the like or it may be formed of metal, e.g., stainless steel, or of other materials of construction compatible with the chemical composition of the product to be packaged. In fabricating the bung in FIGS. 1, 2, and 3, the thread diameter of the bung 10*b* and the thread type 11 of the original container bung are duplicated. The top of the special bung above the threads is greater in diameter 12 and thickness 13 than the original bung in order to provide for two or more wrench flats 14. The thread type 11 may be national pipe thread, buttress thread, machine thread, or any other thread type required to match the thread used in the container bung opening.

Figure 3A:
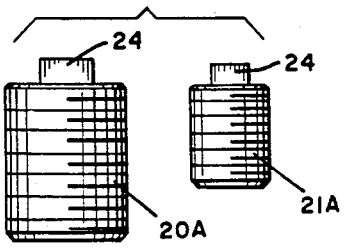
FIG. 3A shows the side elevational view and FIG. 3B the plan view of a variant form of plugs for the bung openings
Figure 3B:
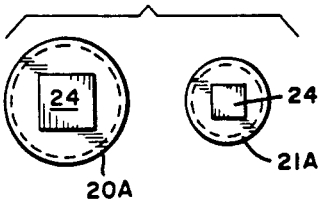

As shown in FIG. 3, the bung 10 may be provided with a different thread type 11B and is made to accommodate plugs as shown in FIGS. 3A and 3B which may be of different configuration. The plugs 20 and 21 of FIGS. 1 and 2 and plugs 20*a* and 21*a* of FIG. 3A and FIG. 3B may be made of the same material of construction as the bung. Plug styles may vary in that plastic plugs may have a slot 22 in the top to fit a bung wrench (FIG. 1), while stainless steel plugs may have wrench flats 24 projecting above the top (FIG. 3A). As noted above, these plugs may be secured to the bung by a tether (shown as 23 in FIGS. 1 and 2) which tether may be made of wire, chain, plastic, or other material. These plugs are secured in the openings 15 and 16 when the container is shipped. In use, the smaller opening in the bung, e.g. plug 21 is removed from the opening 16 and replaced with a gas filter. In the case of the larger opening, which has the dip tube already in place secured at the bottom of opening 15, the plug 20 is replaced with a suitable fitting at the end of the liquid withdrawal line that is connected to the container bung opening 15

Figure 7:
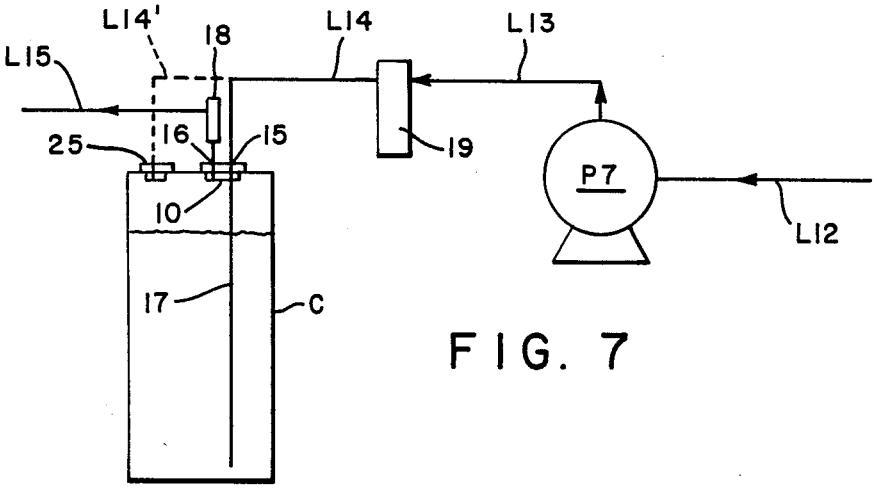
FIG. 7 is a schematic to illustrate still a further adaptation of the bung of the invention in which a container known to be clean is filled with purified material.
Figure 8:
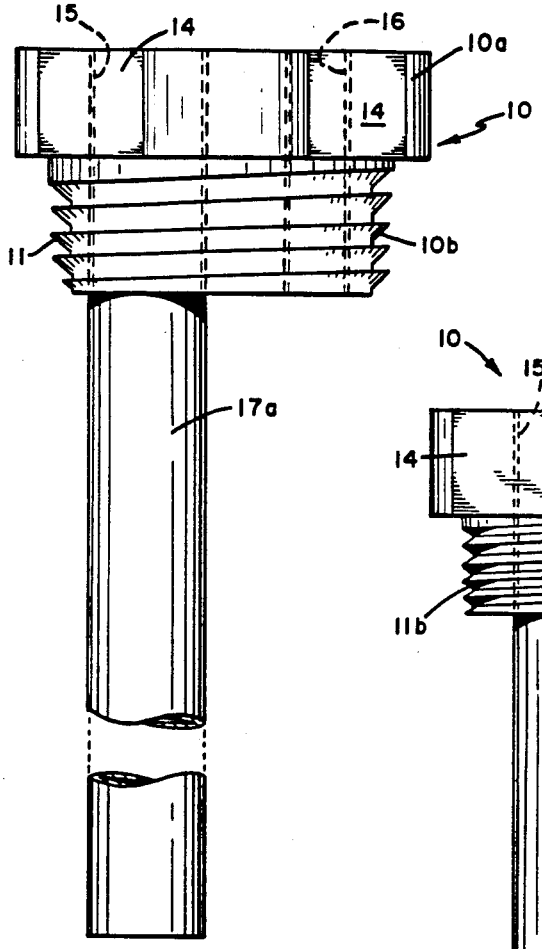
FIG. 8 illustrates on a larger scale the bung with dip tube secured therein.
Figure 9:
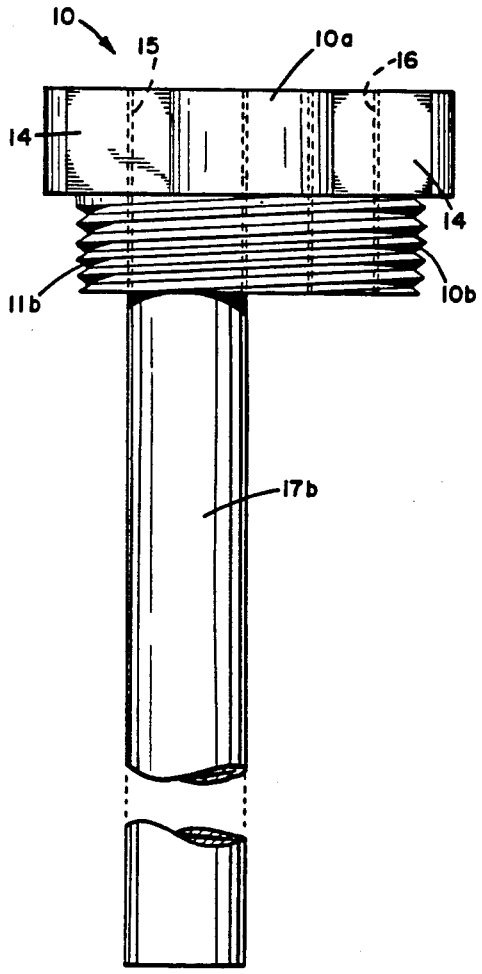
FIG. 9 is an illustration similar to FIG. 8 wherein a bung with variant thread design is shown.

Illustrated in FIGS. 8 and 9 with dip tubes 17*a* and 17*b* attached are the bungs of FIG. 2 and FIG. 3, respectively. The dip tube 17 is sized to extend close to, but preferably not engage, the bottom of the bulk container and is secured to the bung in any suitable air tight container. Shown in FIG. 4 through FIG. 7 are several systems in accordance with the invention adaptable with the bung hereinabove described. In general, the invention, in conjunction with the bung described in the present application, permits a variety of means for facilitating the packaging, shipment and use of high purity liquids so as to effectively minimize contamination and meet the high standards required in such fields as semiconductor manufacturing and in the pharmaceutical industries, for example. The system, in addition to the special bung and standard bulk container, utilizes one or more of several additional components, i.e., an air filter, a pump, and a highly effective, such as 0.2 micron, liquid filter.

Figure 4:
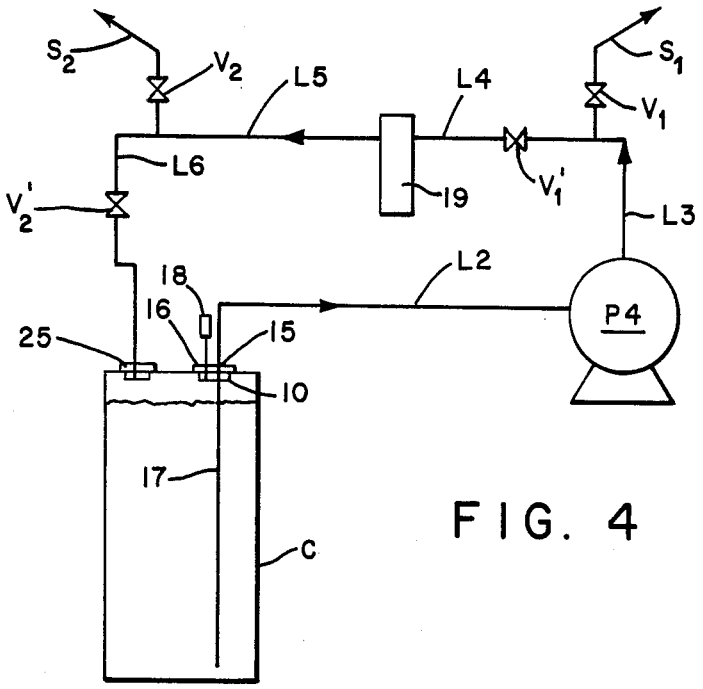
FIG. 4 illustrates in schematic form an adaptation of the system of the invention in which the liquid contents of a container are recirculated to enhance the purity thereof.

The system illustrated in FIG. 4 provides the capability of readily upgrading and/or maintaining the high purity of a chemical in a shipping container or drum by utilizing a bung 10 with a plurality of holes, i.e., at least one hole 15 in which is secured a dip tube 17 and at least one other hole 16 in which a vent or gas filter element 18 may be connected at the time of use. The arrangement of shipping container C and bung 10 with dip tube 17 and a vent or gas filter 18, as above described, in combination with a liquid pressurizing means, e.g., pump P4, a liquid product filter 19 and interconnecting liquid conduits, i.e. plumbing lines L2, L3, L4, L5 and L6, provides a system which markedly facilitates the maintenance and immediate availability for use in a high purity state of the liquid product. The system may incorporate one or more sampling parts as shown at $S_1$ accompanied by suitable shut off valves $V_1$ and $V_1$, the latter normally open is shut and the former (normally shut) is opened when a sample is to be drawn. Additionally a second sampling or withdrawal port $S_2$ may be incorporated with accompanying valves $V_2$ and $V_2$, which function similarly to the valves v, and $v_1$, respectively. The invention has primary utility in processing liquid chemicals employed in processing electronic, e.g. semiconductor components in which high purity of chemicals to avoid contamination is essential. It will be apparent, however, that the system may be applied also to other liquid products, e.g., hydraulic fluids, where a high state of purity in the liquid is important.

The purification system of the invention in a most productive application involves the recirculation of the liquid in the container C to reduce impurities that may be present therein. In so doing the liquid product is withdrawn through the dip tube 17 by the pump P4 and fed through the product filter 19 and then returned to the container C through the second opening in the container C shown capped by a second bung 25. A vent filter 18 positioned in the second opening in the bung 10, contiguous to the dip tube 17 avoids build-up of pressure or vacuum in the system.

Figure 5:
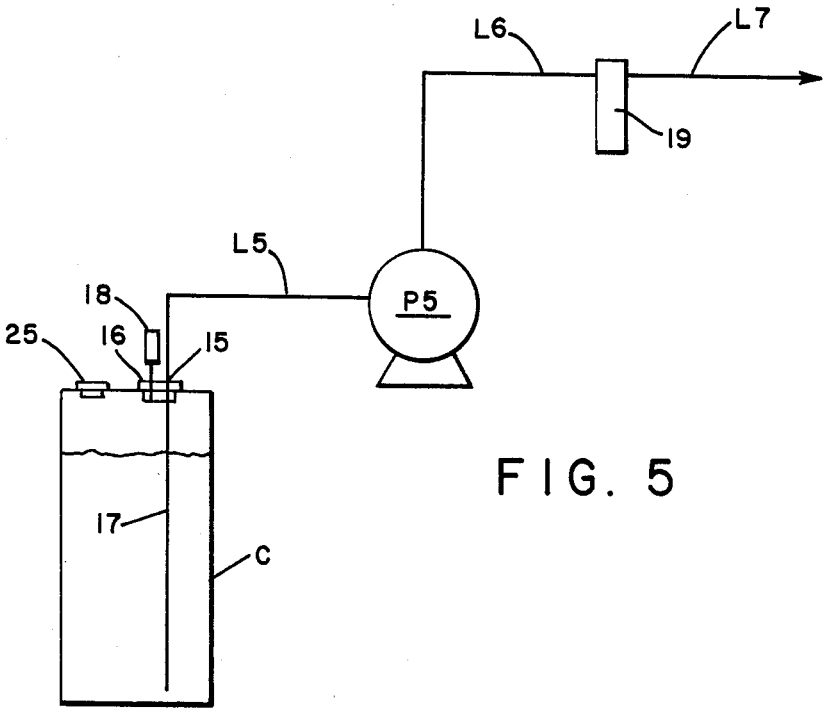
FIG. 5 is a schematic showing another adaptation of the bung arrangement of the invention illustrating the unloading of a container while the replacement air is purified.

In FIG. 5 an arrangement that maintains the purity of the product in the container C is illustrated. As described in further detail hereafter, the product withdraws through line L5 by the action of pump P5 through the dip tube 17 positioned in the larger 15 of the two holes in the bung 10 and is transported for use through line L6. If desired, an additional filtration may be performed by passing the liquid through a suitable filter such as a 0.2 micron filter 19 and then to the discharge line L7. To preclude entry of contaminated air into the container C as the product is withdrawn, an air filter 18 is positioned in the smaller 16 of the two openings in the bung 10.

Figure 6:
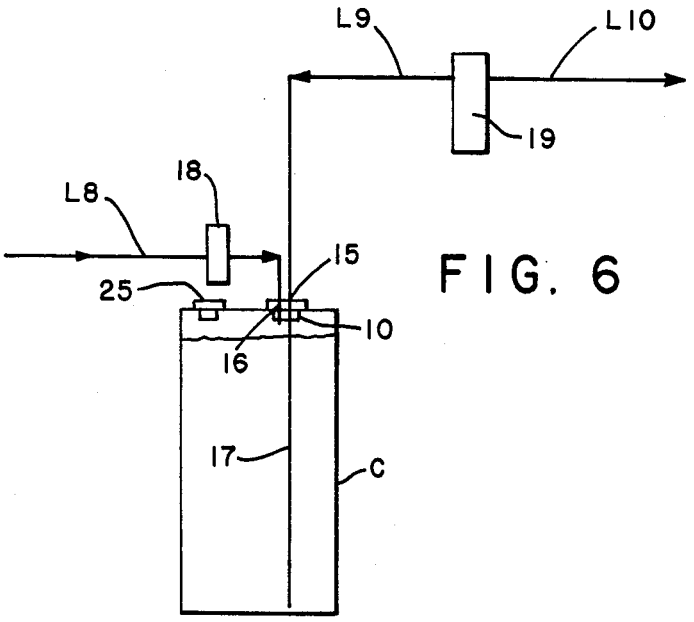
FIG. 6 is still another schematic showing a further adaptation of the bung arrangement of the invention in which the container is unloaded by pressure.

FIG. 6 illustrates a system similar to that of FIG. 5, except that instead of withdrawing the product from the container C by pump, a pressure system is used. As shown, pressurized air through line L8 is passed through filter 18 into the container C through the smaller 16 of the holes in the bung 10 to displace the liquid in the container and force it up through dip tube 17, positioned in the bung opening 15, line L8, the filter 19, and finally exit line L10.

Shown in FIG. 7 is an arrangement for filling a clean container C containing a filtered product with an unfiltered or relatively impure product. Product drawn from a source through line L12 passes through pump P7, line L13, filter 18 and line L14 and is introduced into the container C through the dip tube 17 positioned in the larger opening 15 of the bung 10. Alternatively, the product may be introduced through line L14' (shown in broken line) in the bung 25 in which case the opening 15 would be sealed. Air displaced from the container C as the container fills is suitably cleansed or purged by passing through a suitable filter 18 of vapors which would otherwise contaminate the atmosphere or create a hazard before the extract is discharged through line L15. Of course, when liquid is being withdrawn from the container C, the vent filter 18 functions to purify air entering the container.

As noted above, the bung 10 is provided with at least a pair of openings 15 and 16 with closure plugs 20 and 21 for use in stopping the product. In a preferred embodiment, the bung 10 has one $\frac{3}{4}''$ NPT threaded opening 15 and one $\frac{1}{4}''$ NPT threaded opening 16 drilled and tapped from both sides of the bung. The $\frac{3}{4}''$ NPT opening 15 is fitted with a $\frac{3}{4}''$ dip tube 17 (FIGS. 8 and 9, and which is shown diagrammatically in FIGS. 4–7) which reaches into the container to within about $\frac{1}{4}''$ of the bottom. The dip tube 17 may be made of the same material of construction as the special bung which, depending on the contents and regulatory requirements, may be either steel, plastic, etc. The filtered product is pumped out of the cleansed container through dip tube 17.

The $\frac{1}{4}''$ NPT or smaller opening 16 in the special bung is used in various different applications, of which the following four, made by reference to FIGS. 4–7, are typical.

I. After a container has been cleaned and fitted with a special bung (FIGS. 1, 2, and 3) and dip tube 17 (FIGS. 8 and 9), the container is filled with a product of suitable purity. To enhance the purity of the product, for example, unfiltered product is pumped from storage tanks or drums through a filter (or filters) 19 into the clean container. As the container fills with product, the air in the container, together with any product fumes, will escape through the $\frac{1}{4}''$ NPT opening 16 and a filter 18 which is screwed into the opening 16. The filter 18 may be connected to an exhausting system.

II. In a more typical application, a clean container is filled with product, the material is recirculated through one or more filters 19, as in FIG. 4. This step is important to remove any particulate contamination which may have been left in the container after cleaning or which may have been introduced in the filling process. In recirculating the product, a pump draws up the material through the dip tube 17 which is secured in the bottom of $\frac{3}{4}''$ NPT opening 15 in the special bung 10 and pumps the product through filter 19 and back into the container C through suitable plumbing, lines L5 and L6 through a $\frac{3}{4}$ inch opening in bung 25. A gas filter 18 is connected to the ¼" NPT opening 16 in the special bung 10. The liquid filter element 19 has been shown as a single unit; it will be understood, however, that multiple units may also be used depending at the flow rate desired.

The sampling ports $S_1$ and $S_2$ may be using for monitoring the purity of the product or optionally these ports may be used to withdraw the liquid product.

III. A further application for the ¼" NPT opening 16 resides in the avoidance of contamination of the pure product during unloading of the product from a bulk container by using a pump. Before the product is pumped out of the container through the dip tube 17, a filter 18 is attached to the ¼" opening 16 as shown in FIG. 5. Filter 18 will permit clean air to enter the container as product is removed thus preventing a vacuum build-up in the container.

IV. In still another use for the ¼" opening 16 also relating to unloading, the material is withdrawn from the container by using filtered nitrogen or air pressure. The pressuring gas line is connected through a filter 18 to the ¼" NPT opening 16 as in FIG. 6. As the gas pressure (7 psig max) builds up in the container, the product will flow out of the dip tube 17 which is suitably attached to the ¾" opening 15 in the special bung.

After a cleaned container has been filled, recirculated, and checked for quality, it must be made ready for shipment. To accomplish this, any fittings, lines, or filters screwed into the top side of the ¾" NPT opening 15 or the ¼" NPT opening 16 in the special bung must be removed and replaced with ¾" NPT plug 20 and ¼" NPT plug 21 as shown in FIG. 1 and 2.

Although the invention has been described and illustrated in connection with preferred embodiments, it will be understood that modifications and variations may be made without departing from the essence and scope of the invention as defined in the appended claims.

I claim:

1. A system for maintaining and upgrading the high purity of a liquid in a shipping container comprising:

(a) a shipping container;

(b) a first bung positioned in a first opening in said container, said first bung being provided with at least two openings and a dip tube connected to a first opening in the first bung;

(c) a second bung in position in a second opening in said container;

(d) a pump for withdrawing said liquid from the container;

(e) a liquid filter; and (f) a vent filter which is secured to a second opening in the first bung;

said pump functioning to withdraw the liquid from the container through said dip tube and to feed said liquid through the liquid filter and to return the filtered liquid to the container through the second opening in said container, said vent filter being connected to the interior of said container to prevent build up of pressure or vacuum in said container.

2. The system of claim 1 wherein the first opening in said first bung comprises a first threaded opening of larger diameter and a second opening in said first bung having a threaded opening of smaller diameter each of said openings being provided with a threaded closure plug which mates with said first and second openings.

3. The system of claim 2 wherein the said closure plugs are tethered with a flexible tie to retain the plugs and prevent misplacement when the plugs are removed from the bung flow openings.

4. The system of claim 1 provided with a liquid sampling port interposed between said pump and said liquid filter.

5. The system of claim 1 provided with a withdrawal port between said liquid filter and said second opening in said container.

* * * * *